US007249752B1

(12) United States Patent
Foley

(10) Patent No.: US 7,249,752 B1
(45) Date of Patent: Jul. 31, 2007

(54) HAND TOOL FOR EXTRACTING A FASTENER FROM A MATERIAL

(76) Inventor: Michael J. Foley, 130 Treasure La., Hailey, ID (US) 83333

( * ) Notice: Subject to any disclaimer, the term of this patent is extended or adjusted under 35 U.S.C. 154(b) by 143 days.

(21) Appl. No.: 11/056,837

(22) Filed: Feb. 11, 2005

(51) Int. Cl.
*B25C 11/00* (2006.01)

(52) U.S. Cl. ..... 254/23; 29/270; 29/268

(58) Field of Classification Search ..... 254/23, 254/24–28; 29/278, 270
See application file for complete search history.

(56) References Cited

U.S. PATENT DOCUMENTS 1,989,918 A * 2/1935 Drypolcher ..... 254/28
3,150,666 A * 9/1964 Averbach ..... 606/140
6,701,560 B2 3/2004 Foley
6,826,831 B2 * 12/2004 Crawley ..... 29/861
2003/0229976 A1 * 12/2003 Scheller et al. ..... 29/17.2

* cited by examiner

*Primary Examiner*—Lee D. Wilson
(74) *Attorney, Agent, or Firm*—Eric Karich

(57) ABSTRACT

A hand tool is disclosed for extracting a fastener from a material. The hand tool includes a pair of elongate members joined by a pivot to form a pair of jaws and a pair of handles. The pair of jaws are operated by moving the pair of handles relative to one another, and have teeth adapted for gripping a portion of the fastener. Each of the elongate members is curved longitudinally in a plane including an axis of the pivot such that when the fastener is gripped in the pair of jaws, a force applied to the handles tends to extract the fastener from the material while minimizing damage to the material.

10 Claims, 4 Drawing Sheets

HAND TOOL FOR EXTRACTING A FASTENER FROM A MATERIAL

BACKGROUND OF THE INVENTION

1. Field of the Invention

This invention relates generally to hand tools, and more particularly to hand tools with pivoting jaws for extracting nails.

2. Description of Related Art

Fasteners such as nails are commonly used to fasten objects to materials such as wood. Finish nails and brads are generally relatively small, thin nails with small heads at one end. Finish nails and brads are typically used in lighter applications where appearance is important.

The common hammer is often used to drive nails into materials such as wood. A typical hammer has a head attached to one end of a handle. The head of the hammer has a flat face on one side for striking nails, and a pair of claws on an opposite side for removing nails. However, powered nail guns are increasingly being used instead of hammers, especially by professional installers, and a typical nail gun does not have features for removing nails. Further, the claws of most hammers do not grip heads of finish nails and brads well. Further still, the heads of finish nails and brads are typically driven slightly below surface levels of materials being attached so the fasteners are less visible. In order to extract such fasteners (e.g., using the claws of a hammer), the heads must first be raised above the surface levels.

The current state of the art is disclosed in Foley, U.S. Pat. No. 6,701,560 B2, which teaches a nail-pulling tool that has a two-piece proximal handle pivotally joined with a two-piece distal jaw by a pivoting means. The distal jaw is operated like a standard hand tool with compression of the handle causing the jaw to close, and vice-versa. The distal jaw has an elliptical surface so that with the distal jaw resting on a work surface and closed about a nail protruding from the work surface, and with the handle laying adjacent the work surface, raising the handle away from the work surface in an arc, causes the nail to be pulled from the work surface at an ever increasing rate. Axially oriented jaw teeth provide improved gripping and a pair of tongue and groove opposing surfaces enable cutting and further improved gripping. A hammer surface enables driving of a nail into the work surface rather than pulling it out, and a claw element enables pulling a nail head up so as to be better gripped by the tool. The tool is ideally designed for pulling a bent nail partially upward, straightening it, and then hammering it back into the surface in a more correct and improved manner for accomplishing its fastening task.

It would be beneficial to have a hand tool specially adapted to extract a fastener from a material. Such a hand tool would ideally be capable of easily accessing a fastener having a head located below a surface level of a material.

SUMMARY OF THE INVENTION

A hand tool is disclosed for extracting a fastener from a material. The hand tool includes a pair of elongate members joined by a pivot to form a pair of jaws and a pair of handles. The pair of jaws are operated by moving the pair of handles relative to one another, and are adapted for gripping a portion of the fastener. Each of the elongate members is curved longitudinally in a plane that includes an axis of the pivot such that when the fastener is gripped in the pair of jaws, a force applied to the handles tends to extract the fastener from the material while minimizing damage to the material.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
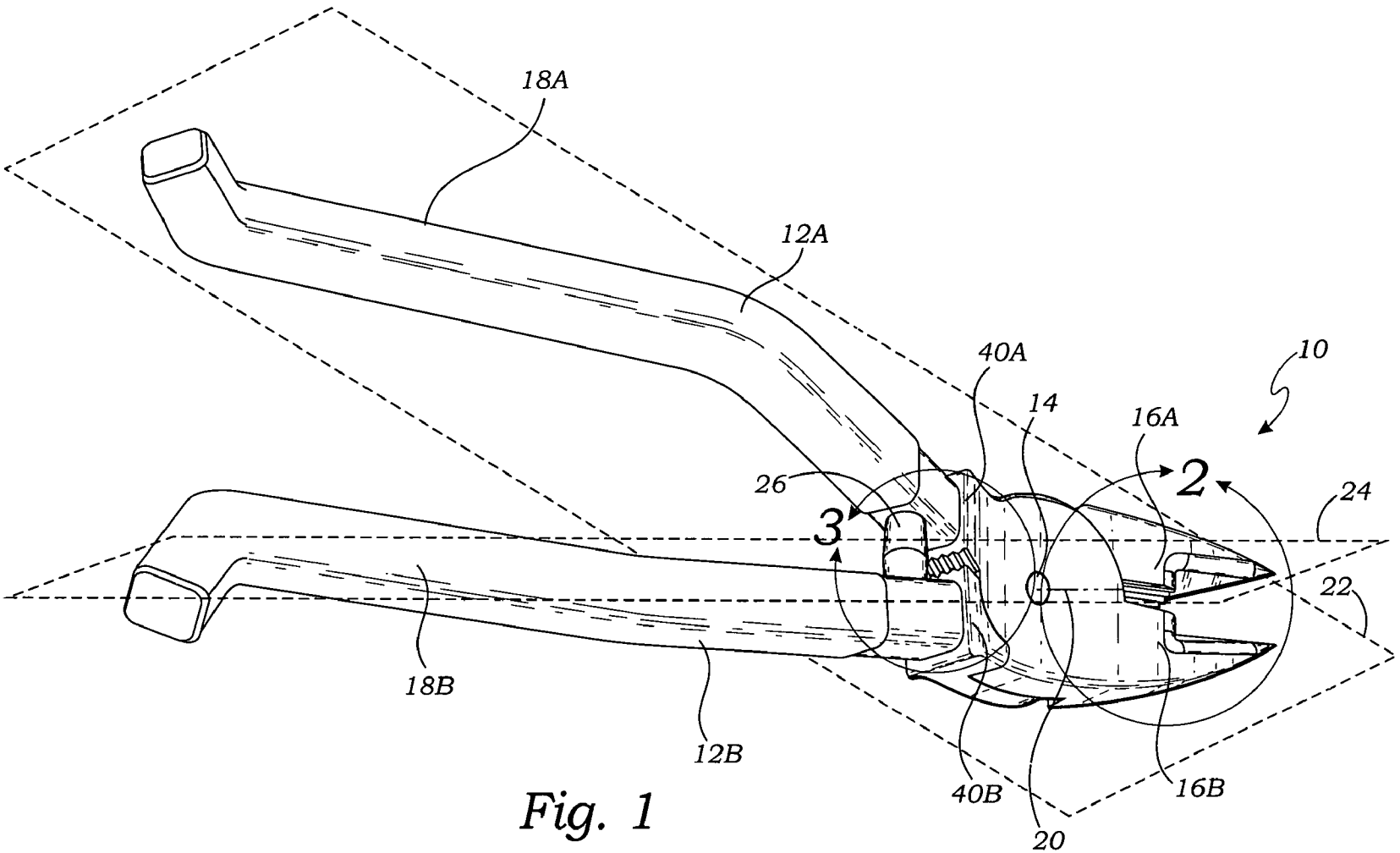
FIG. 1 is a perspective view of one embodiment of a hand tool for extracting a fastener from a material.

FIG. 1 is a perspective view of one embodiment of a hand tool 10 for extracting a fastener from a material. The material is preferably a slightly compressible material such as wood, and the fastener is preferably a long, thin fastener such as a nail or a brad that has been driven lengthwise into the material by applying a force to an end of the fastener. In the embodiment of FIG. 1, the hand tool 10 includes a pair of elongate members 12A and 12B joined by a pivot 14 to form a first pair of jaws 16A and 16B on one side of and adjacent to the pivot 14, a second pair of jaws 40A and 40B on another side of and adjacent to the pivot 14, and a pair of handles 18A and 18B extending outwardly from the pivot 14. In general, the first pair of jaws 16A-16B and the second pair of jaws 40A and 40B are operated by moving the pair of handles 18A-18B relative to one another. More specifically, the jaws 16A-16B and 40A and 40B move toward one another when the pair of handles 18A-18B are moved toward one another.

The pivot 14 is substantially cylindrical, and has an axis 20 extending through a center. The elongate member 12A is advantageously curved longitudinally in a plane 22 including the axis 20 of the pivot 14. Similarly, the elongate member 12B is advantageously curved longitudinally in a plane 24 including the axis 20 of the pivot 14. More specifically, the elongate members 12A-12B are generally "S"-shaped in the respective planes 22 and 24. As described in more detail below, when the fastener is gripped in the pair of jaws 16A-16B or 40A and 40B, a force applied to the handles 18A-18B tends to extract the fastener from the material. In general, the extracting force is applied in a direction substantially perpendicular to a plane including the pair of handles 18A-18B, either up or down depending upon the jaws 16A-16B or 40A and 40B being utilized.

While the preferred embodiment includes both pairs of jaws 16A-16B and 40A and 40B, in alternative embodiments the hand tool 10 may have only one of the pairs of jaws 16A-16B or 40A and 40B.

In the embodiment of FIG. 1, a spring system 26 is disposed between the pair of handles 18A-18B for urging the handles 18A-18B away from one another. This urging advantageously opens the jaws 16A-16B so that the jaws 16A-16B can be positioned on opposite sides of the fastener.

Figure 2:
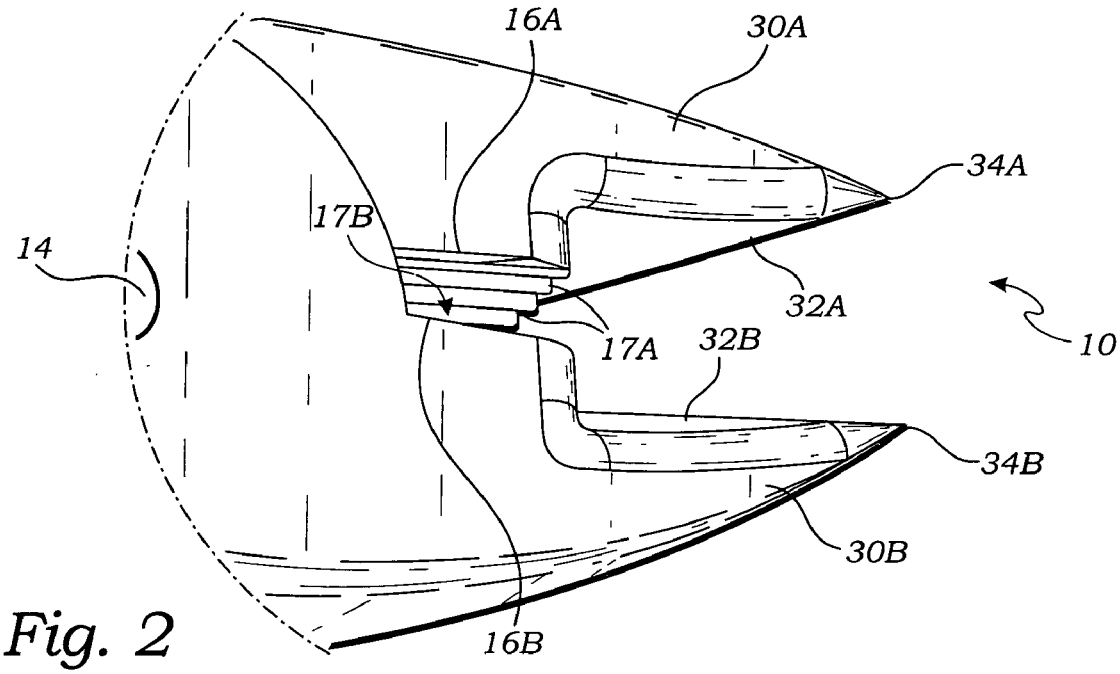
FIG. 2 is a portion of the hand tool of FIG. 1 as indicated in FIG. 1.
Figure 5:
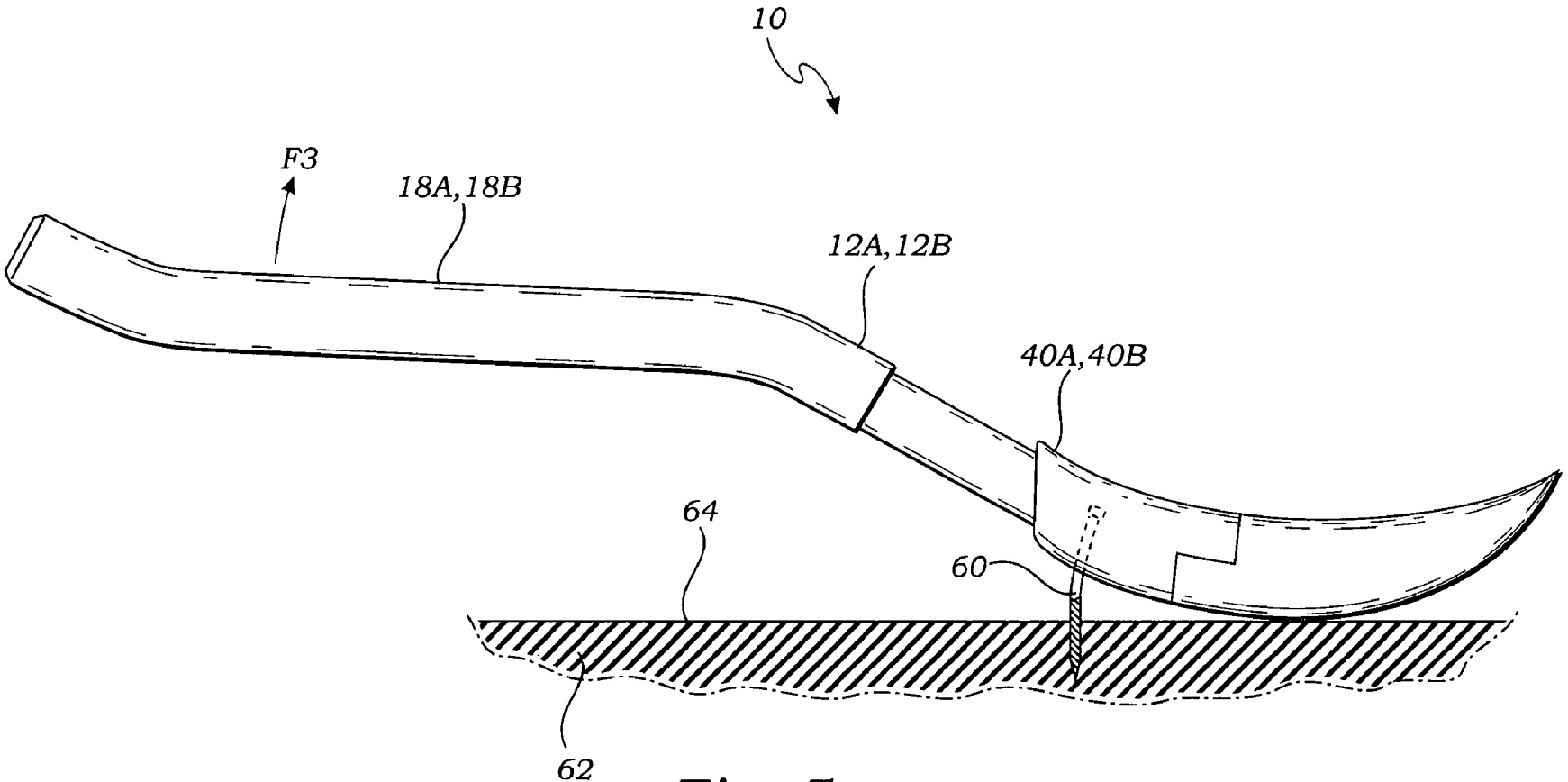
FIG. 5 is a side elevation view of the hand tool illustrating another way of using the hand tool of FIGS. 1-3 to extract a fastener lodged in a material.

FIG. 2 is a portion of the hand tool 10 of FIG. 1 as indicated in FIG. 1, including the pair of jaws 16A-16B. As shown in FIG. 2, the pair of jaws 16A-16B include teeth 17A-17B that intermesh. The teeth 17A-17B are preferably laterally spaced and extend longitudinally with respect to the hand tool 10, perpendicular to any fasteners that are to be removed. The teeth 17A-17B function to grip the fastener, as shown in FIG. 5, and may even function to crimp the fastener to ensure a firm grip on the fastener, as described in greater detail below.

Each of the pair of jaws 16A-16B preferably includes a sharp extension 30A-30B. The sharp extensions 30A-30B are adapted for gripping a portion of the fastener and potentially for digging the head of the fastener out of any material that may impede removing the fastener. The sharp extensions 30A-30B of the pair of jaws 16A-16B move toward one another when the pair of handles 18A-18B (see FIG. 1) are moved toward one another. The sharp extensions 30A-30B are preferably "V"-shaped when the pair of handles 18A-18B are closed, and preferably have sharp edges 32A-32B that move toward one another when the pair of handles 18A-18B (see FIG. 1) are moved toward one another, to form the "V"-shape. Furthermore, the jaws 16A-16B preferably have pointed tips 34A-34B to aid in gripping an end of the fastener when the end of the fastener is below a surface of the material.

Figure 3:
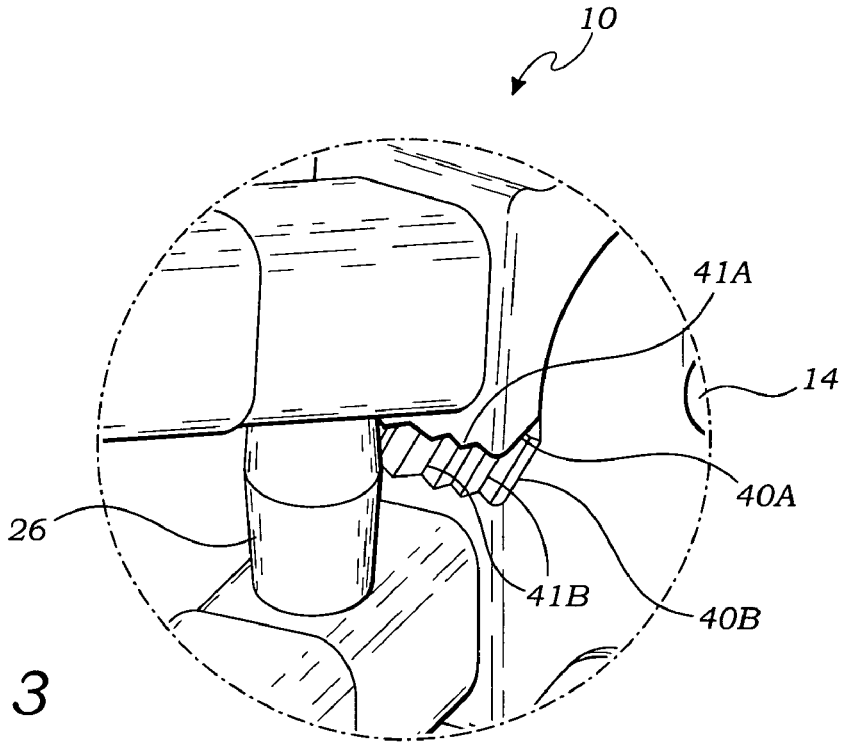
FIG. 3 is another portion of the hand tool of FIG. 1 as indicated in FIG. 1.

FIG. 3 is another portion of the hand tool 10 of FIG. 1 as indicated in FIG. 1. As shown in FIG. 3, the hand tool 10 has a second pair of jaws 40A and 40B on the side of the pivot 14 opposite the first pair of jaws 16A-16B (see FIGS. 1-2). Like the pair of jaws 16A-16B, the pair of jaws 40A-40B have teeth 41A-41B that intermesh as described above.

Figure 4:
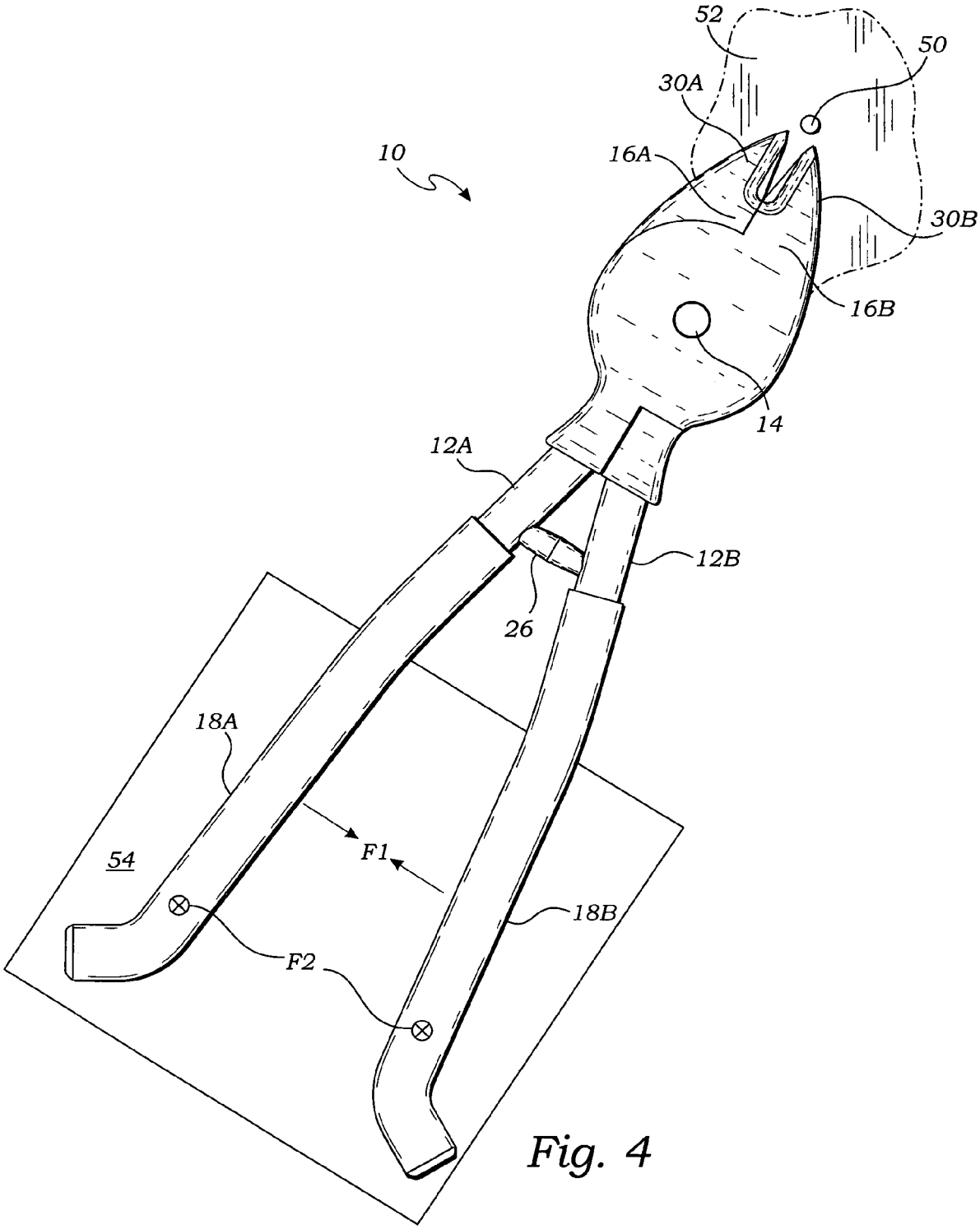
FIG. 4 is a top plan view of the hand tool illustrating one way of using the hand tool of FIGS. 1-3 to extract a fastener lodged in a material.

FIG. 4 illustrates one way of using the hand tool 10 of FIGS. 1-3 to extract a fastener 50 lodged in a material 52. The fastener 50 may be, for example, a nail or a brad, and the material 52 may be, for example, wood. In FIG. 4, an end of the fastener 50 is below a surface of the material 52 such that a shaft of the fastener 50 is not accessible. In the method of FIG. 4, the a force "F1" is applied between the handles 18A-18B such that the handles 18A-18B move toward one another, and the pair of jaws 16A-16B are closed. In this configuration, the "V"-shaped sharp extensions 30A-30B can be used to dig the fastener 50 from the material 52, using the pointed tips 34A-34B and the sharp edges 32A-32B. The sharp edges 32A-32B can also be used to grip and extract the fastener 50. In some instances, the brad or similar fastener 50 is removed from the back and actually pulled though the material 52, thereby removing the need to dig the head of the fastener out of the material 52.

In FIG. 4, the handles 18A-18B exist in a plane 54, the force F1 is applied in the plane 54. To extract the fastener 50 from the material 52, a second force "F2" is applied to the handles 18A-18B. In general, the extracting force F2 is applied in a direction substantially perpendicular to the plane 54. In FIG. 4, the extracting force F2 is applied into the page as indicated. During the extraction process, the elongate members 12A-12B act as levers. Portions of the elongate members 12A-12B about the pivot 14 contact the surface of the material 52, forming a fulcrum. As the extracting force F2 is applied to the handles 18A-18B, "V"-shaped sharp extensions 30A-30B move away from the surface of the material 52, taking the fastener 50 with them. The above steps may be performed once, or may be repeated several times. In the end, the fastener 50 is extracted from the material 52.

FIG. 5 illustrates another way of using the hand tool 10 of FIGS. 1-3 to extract a fastener 60 lodged in a material 62. The fastener 60 may be, for example, a nail or a brad, and the material 62 may be, for example, wood. In FIG. 5, an end of the fastener 60 is above a surface 64 of the material 62 such that a shaft of the fastener 60 is accessible. In the method of FIG. 5, the pair of jaws 40A-40B (see FIG. 3) are positioned on opposite sides of the shaft of the fastener 60 near the surface 64 of the material 62. A force is applied between the handles 18A-18B such that the handles 18A-18B move toward one another, and the pair of jaws 40A-40B grip the shaft of the fastener 60.

In FIG. 5, the handles 18A-18B exist in a plane, the force used to move the handles 18A-18B toward one another is applied in that plane. To extract the fastener 60 from the material 62, a force "F3" is applied to the handles 18A-18B. The extracting force F3 is applied in a direction substantially perpendicular to the plane including the handles 18A-18B. In FIG. 5, the extracting force F3 is applied in a direction away from the surface 64 of the material 62 as shown. During the extraction process, the elongate members 12A-12B act as levers. Portions of the elongate members 12A-12B about the pivot 14 (see FIGS. 1-3) contact the surface 64 of the material 62, forming a fulcrum. As the extracting force F3 is applied to the handles 18A-18B, the jaws 40A-40B move away from the surface 64 of the material 62, taking the fastener 60 with them. The above steps may be performed once, or may be repeated several times. In the end, the fastener 60 is extracted from the material 62.

While FIG. 5 illustrates the use of the pair of jaws 40A-40B and force F3 to remove the fastener 50, it will be understood that the pair of jaws 16A-16B could also be used in a similar fashion, using force F2 to extract the fastener 50. The curved shape of the hand tool 10 enables the hand tool 10 to exert considerable force without harm to the material 64. In the preferred embodiment, each of the elongate members 12A-12B includes a spoon shaped lower surface 66 adjacent the pivot 14 (shown in FIGS. 1-4) of the hand tool 10 to most effectively prevent damage to the material 62.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A hand tool for extracting a fastener from a material, the hand tool comprising:

a pair of elongate members joined by a pivot to form a pair of handles that extend from the pivot;

a first pair of jaws extending from the pivot opposite the pair of handles, wherein the first pair of jaws each include teeth that intermesh for gripping the fastener and are operated by moving the pair of handles relative to one another;

a second pair of jaws, each having teeth, opposite the pivot and the first pair of jaws;

a spring positioned between the second pair of jaws and the pair of handles; and a sharp extension extending from each of the pair of jaws, wherein the sharp extensions include sharp edges that move toward one another when the pair of handles are moved toward one another, and wherein the sharp extensions form a generally "V"-shape when the pair of jaws abut one another.

2. The hand tool as recited in claim 1, wherein the sharp extensions extend to sharp points suitable for digging the fastener from the material.

3. The hand tool as recited in claim 1, wherein the teeth are laterally spaced and extend longitudinally with respect to the pair of elongate members.

4. The hand tool as recited in claim 1, further comprising a second pair of jaws formed between the pair of handles and the pivot, the second pair of jaws each include teeth that intermesh for gripping the fastener and are operated by moving the pair of handles relative to one another.

5. The hand tool as recited in claim 4, wherein the teeth of the second pair of jaws are laterally spaced and extend longitudinally with respect to the pair of elongate members.

6. A method of extracting a fastener from a material, the method comprising the steps of:

providing a hand tool comprising:

a pair of elongate members joined by a pivot to form a pair of handles that extend from the pivot;

a first pair of jaws extending from the pivot opposite the pair of handles, wherein the first pair of jaws each include teeth that intermesh for gripping the fastener and are operated by moving the pair of handles relative to one another;

a second pair of jaws, each having teeth, opposite the pivot and the first pair of jaws;

a spring positioned between the second pair of jaws and the pair of handles; and a sharp extension extending from each of the first pair of jaws, wherein the sharp extensions include sharp points and sharp edges that move toward one another when the first pair of handles are moved toward one another, and wherein the sharp edges form a generally "V"-shape when the pair of jaws abut one another; and a spoon shaped lower surface formed on each of the elongate members adjacent the pivot for minimizing damage to the material during use of the hand tool; and digging into the material using the sharp points of the sharp extensions to position the sharp extensions under the fastener;

positioning the fastener between the sharp edges of the sharp extensions;

closing the pair of handles, thereby gripping the fastener between the sharp edges of the sharp extensions; and applying a force to the handles, thereby at least partially extracting the fastener from the material while minimizing damage to the material.

7. The method of claim 6, wherein the teeth of the hand tool are laterally spaced and extend longitudinally with respect to the pair of elongate members.

8. The method of claim 6, wherein the second pair of jaws each include teeth that intermesh for gripping the fastener and are operated by moving the pair of handles relative to one another.

9. The method of claim 8, wherein the teeth of the second pair of jaws of the hand tool are laterally spaced and extend longitudinally with respect to the pair of elongate members.

10. The method of claim 8, further comprising the steps of:

positioning the second pair of jaws on either side of the at least partially extracted fastener;

closing the pair of handles, thereby gripping the fastener between the second pair of jaws; and applying a force to the handles, thereby completely extracting the fastener from the material while the spoon shaped lower surface minimizes damage to the material.

* * * * *